United States Patent [19]

Koyama et al.

[11] 4,330,088

[45] May 18, 1982

[54] MULTISPRAY SYSTEM FOR BEAUTY TREATMENT

[76] Inventors: Masaya Koyama, 4-21-4; Katsuyuki Hanaoka, 4-12-3, both of Kizuri, Higashiosaka-shi, Osaka-fu, Japan

[21] Appl. No.: 108,134

[22] Filed: Dec. 28, 1979

[30] Foreign Application Priority Data

Mar. 30, 1979 [JP] Japan ..... 54-38833

[51] Int. Cl.[3] ..... B05B 7/30

[52] U.S. Cl. ..... 239/318; 239/308; 239/332; 239/346

[58] Field of Search ..... 239/318, 308, 307, 304, 239/343, 346, 8, 266, 269, 373, 415, 372, 526, 600, 332; 222/608

[56] References Cited

U.S. PATENT DOCUMENTS 2,709,024 5/1955 Lemoine et al. ..... 222/212
3,675,851 7/1972 Merfeld et al. ..... 239/318
3,752,404 8/1973 Forsberg ..... 239/308
4,030,665 6/1977 Koyama ..... 239/332
4,159,804 7/1979 Rigemonti ..... 239/346

FOREIGN PATENT DOCUMENTS 2750220 5/1979 Fed. Rep. of Germany ..... 239/346

*Primary Examiner*—James B. Marbert
*Attorney, Agent, or Firm*—Francis X. LoJacono

[57] ABSTRACT

A multispray system for beauty treatment in which a motor and a pump are mounted on a wagon and interconnected to each other to generate high pressure sufficient to spray a liquid through at least two pipes which are respectively connected to an atomizing sprayer and a foam sprayer, whereby the atomized spraying is performed by means of air under high pressure, and the foam spraying is performed by means of suitably reduced air pressure.

3 Claims, 6 Drawing Figures

MULTISPRAY SYSTEM FOR BEAUTY TREATMENT

BACKGROUND OF THE INVENTION

This invention relates to a multispray system for beauty treatment.

Conventional foam-spray and atomizing-spray solutions for beauty treatment have generally been discharged with hand sprayers equipped with small-size motors and pumps. In such type sprayers, however, it has been necessary to mount a motor and a pump to each sprayer, thereby increasing the manufacturing cost.

In view of the foregoing, there has recently been developed a multispray system in which a low-pressure pump and a large-size motor are disposed on a wagon, and air is to be distributed and supplied to a plurality of foam sprayers.

In such a system, however, a pump for low pressure has been used and therefore atomizing sprayers requiring high pressure could not be used. This has presented an extreme inconvenience, since in a beauty treatment foam spraying and atomized spraying have to be selectively used, depending upon the treatment solution.

SUMMARY OF THE INVENTION

This invention is proposed in view of the above mentioned drawbacks, and provides an economical multispray system in which both foam sprayers and atomizing sprayers suitable for beauty treatment may be used at the same time.

The multispray system for beauty treatment according to the present invention comprises a beauty-treatment wagon, a motor mounted on the wagon, a pump mounted on the wagon and adapted to be driven by the motor to generate pressure sufficient to spray a liquid, at least two pipes to send compressed air generated by the pump, an atomizing sprayer connected to one of the pipes, and a foam sprayer connected to the other of the pipes and having a pressure-regulator valve.

According to the present invention, a motor and a pump capable of generating high pressure are mounted to a wagon so that an atomizing sprayer may be used; and, on the other hand, a pressure-regulator valve is attached to a foam sprayer so that air pressure suitable to generate foam may be obtained. Namely, in the multispray system of the present invention, a motor and a pump for high pressure are mounted to a wagon on the basis of an atomizing sprayer requiring high pressure, instead of a foam sprayer requiring low pressure on the basis of which conventional multispray systems have been formed, the attachment of the pressure regulator valve to a foam sprayer providing suitable pressure for a foam spray.

Thus, such an arrangement may permit a considerable reduction in the manufacturing cost as compared with a hand sprayer having one motor and one pump, or the usual foam-sprayer system having a motor and a pump for low pressure mounted on a wagon. Furthermore, such an arrangement has the advantage that two kinds of spraying methods required for beauty treatment, by means of the use of atomizing sprayers and foam sprayers, may conveniently be realized at the same time.

Other objects and advantages of the present invention will be apparent from the following description.

BRIEF DESCRIPTION OF THE DRAWINGS

The multispray system for beauty treatment according to the present invention will then be described with reference to the accompanying drawings showing one embodiment thereof, in which.

DETAILED DESCRIPTION OF THE PREFERRED EMBODIMENT

Figure 1:
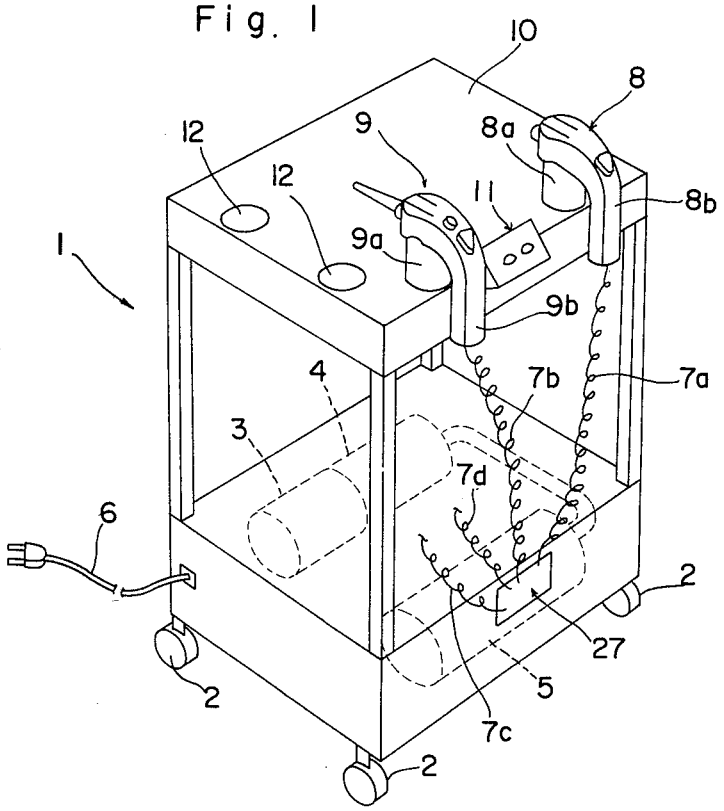
FIG. 1 is a general perspective view of the multispray system of the present invention.

In FIG. 1, which illustrates the whole multispray system in a perspective manner, there is shown a wagon 1 having casters 2. A motor 3, incorporated in the lower portion of the wagon 1, provides sufficient high pressure to an atomizing sprayer and is adapted to be driven by a current through a power-supply cord 6.

A pump (compressor) 4 is connected to the motor 3 and may supply compressed air having high pressure sufficient for an atomizing spray.

Tank 5, for storing compressed air generated by the pump 4, is so constructed as to supply such compressed air at a predetermined gauge pressure.

In this embodiment, four superfine vinyl pipes *7a, 7b, 7c* and *7d* are connected to the tank 5. An atomizing sprayer 8 is connected to the pipe *7a,* and a foam sprayer 9 is connected to the pipe *7b.* Similar sprayers may be connected to the pipes *7c* and *7d,* but they are neither described nor shown in order to simplify the description.

A power switch 11 for the motor 3 is disposed on a plate 10 disposed at the upper portion of the wagon 1.

The atomizing sprayer 8 and the foam sprayer 9 comprise containers 8*a* and 9*a* containing beauty-treatment solutions and sprayer main bodies 8*b* and 9*b,* respectively.

Formed in the top surface of the plate 10 are concaved portions 12 for receiving the containers 8*a* and 9*a* of the respective sprayers 8 and 9. Namely, when the sprayers 8 and 9 are not used, the respective containers 8*a* and 9*a* may be inserted into these concaved portions 12.

Figure 2:
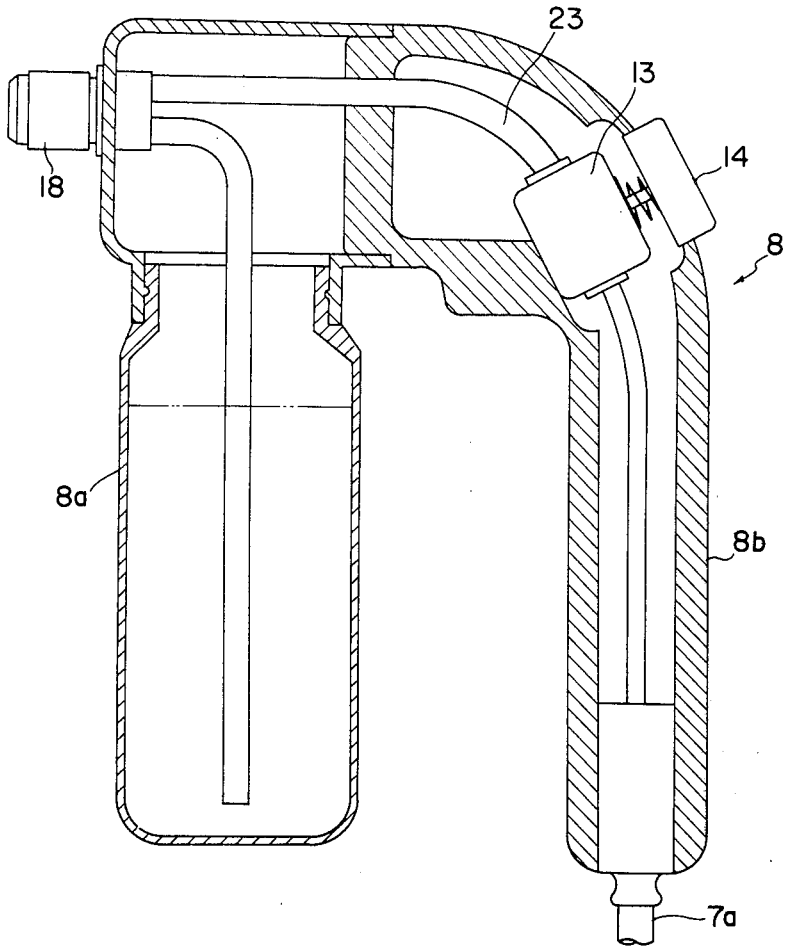
FIG. 2 is a side elevation in vertical section of main portions of an atomizing sprayer.

FIG. 2 is a side elevation in vertical section of the atomizing sprayer 8, the atomizing means being of the well-known suction type.

Figure 5:
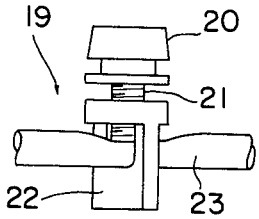
FIG. 5 is a perspective view of a pressure-regulator valve.

A control valve 13 controls the atomizing, and its construction is shown in FIG. 5. This valve 13 is adapted to provide and to interrupt the atomizing caused by compressed air from the pipe *7a.* Namely, pressing an operating means 14 opens the air passage which is normally closed with a spring-loaded ball valve 16, the spring load being provided by spring 15.

That portion of a shaft 17 integral with the operating means 14, which comes in contact with the ball valve 16, is formed at the section thereof in a streamlined shape with respect to the flow of air in order to reduce resistance.

A nozzle 18 for spraying is attached to the tip of the sprayer main body 8*a*.

Figure 3:
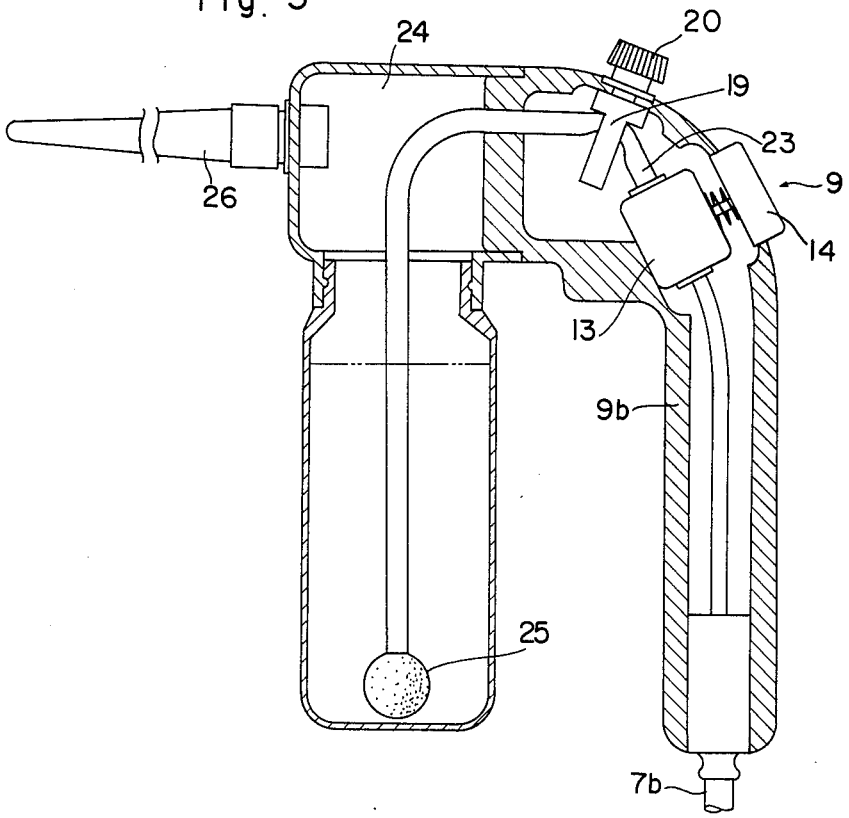
FIG. 3 is a side elevation in vertical section of main portions of a foam sprayer.
Figure 4:
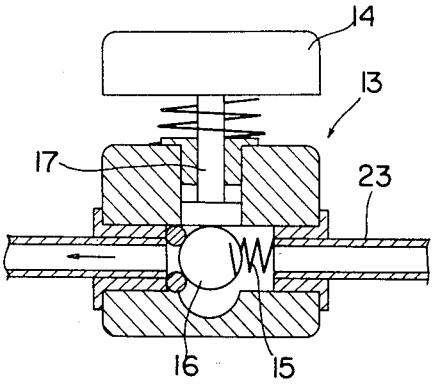
FIG. 4 is a side elevation in vertical section of a control valve.

FIG. 3 illustrates the foam sprayer 9 in a side elevation in vertical section having a control valve 13 disposed therein which is substantially the same as the control valve 13 of the atomizing sprayer 8, the control valve being adapted with an operating means 14.

A pressure-regulator valve is generally designated at 19, and its construction is shown in FIG. 5.

In this pressure-regulator valve 19, there is provided a shaft attached to a knob 20 which is threadably attached to an annular frame 22, into which a pipe 23 is inserted. The inner diameter of pipe 23 may be changed by pressingly deforming said pipe, whereby the flow of air may be controlled.

A sintered member 25 is disposed for generating foam. A foaming chamber is generally designated at 24. A resilient nozzle 26 has therein a core wire to allow the nozzle to be deformed and maintained at a desired angle.

Figure 6:
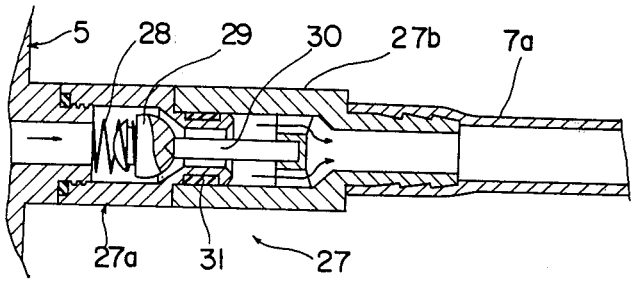
FIG. 6 is an enlarged side elevation in vertical section of the coupling means.

FIG. 6 illustrates a coupling means 27 of the fitted-in type for coupling the pipe 7*a* to the tank 5. While this coupling means 27 of the fitted-in type is also disposed for each of the other pipes 7*b*, 7*c* and 7*d*, the description of the coupling means 27 for the pipe 7*a* will hereinafter be made in detail.

This coupling means 27 of the fitted-in type comprises a male member 27*a* so constructed as to spring-load a ball valve 29 in the normally closed direction by means of a spring 28, and a female member 27*b* having a pressing member 30 to press and open the ball valve 29 against the spring 28 when this female member 27*b* is fitted in the male member 27*a*. The male member 27*a* and the female member 27*b* are attached to the compressed air tank 5 and the pipe 7*a*, respectively. A seal 31 is disposed at the tip of the male member 27*a*.

With the switch 11 turned ON, highly pressurized air is generated by the pump 4 and the compressed air is then stored in the tank 5. Said compressed air is then sent to the atomizing sprayer 8 and the foam sprayer 9 through the pipes 7*a* and 7*b*, respectively. When the control valve 13 of the atomizing sprayer is opened, a beauty-treatment solution in the container 8*a* is sucked and sprayed through the nozzle 18 by the compressed air under high pressure. When the control valve 13 of the foam spray 8 is opened, the pressure of the compressed air is adjusted by means of the pressure-regulator valve 19, so as to be suitable to generate foam. Air having suitably adjusted pressure is then sent to the sintered member 25 for accelerating the generation of foam, thereby providing a foam beauty-treatment solution—shampoo, for example—which is then sprayed through the nozzle 26.

Since the atomizing sprayer 8 and the foam sprayer 9 may be used at the same time, the provision of a number of such sprayers in one wagon may easily permit the performance of two kinds of beauty treatments for several persons with one wagon.

Furthermore, the sprayers 8 and 9 have substantially the same construction, particularly the outer cases thereof; and they may be formed identically with the exception of the nozzle portions, so that reduction in manufacturing cost may be expected.

Further improvements may be possible in such a way that two containers containing two different treatment solutions, respectively, are attached to a sprayer, there being provided an operating means for selecting either solution—thus permitting the selection of an atomized spraying, a foam spraying, or a stop operation. In such a case, two containers may be disposed for respective solutions, but one container may be divided by a partition wall into two chambers, in which different treatment solutions are respectively contained.

Furthermore, since the pipes 7*a* and 7*b* for the atomizing sprayer 8 and foam sprayer 9 are coupled to the compressed-air tank 5 by the coupling means 27 of the fitted-in type, either of the sprayers 8 or 9 may conveniently be repaired by removing only the malfunctioning sprayer.

In addition, the use of the coupling means of the fitted-in type permits one to easily, freely, and rapidly change, as necessary, any number of atomizing or foam sprayers attached to the multispray system, thereby further enhancing the effect of the beauty-treatment multispray system.

We claim:

1. A miltispray system for beauty treatment having a beauty treatment wagon (1), a motor (3) mounted on said wagon (1), a pump (4) mounted on said wagon (1) to be driven by said motor (3), at least two pipes (7*a*, 7*b*) for sending compressed air, a compressed air tank (5) for reserving compressed air from said pump (4), at least one atomizing spray (8) connected to said pipe (7*a*) and at least one foam spray (9) connected to the other pipe (7*b*), coupling means (27) of fitted-in type for connecting each of said pipes (7*a*, 7*b*) to said compressed air tank (5), said atomizing spray (8) and said foam spray (9) being respectively provided with a control valve (13) for providing or interrupting flow of the compressed air supplied through said pipes (7*a*, 7*b*) and with a control valve operating means (14), characterized in that said motor (3), pump (4) and compressed air tank (5) are constructed to produce compressed air having sufficient pressure to spray a liquid and said foam spray (9) has a pressure regulator valve (19).

2. A system as set forth in claim 1, wherein each of said coupling means of the fitted-in type comprises a male member having disposed therein a valve spring-loaded in a normally closed direction by means of a spring, and a female member having a pressing member to press and open said ball valve against said spring when said female member is fitted in said male member, said male member and said female member being attached to said compressed-air tank

3. A system as set forth in claim 1, wherein said atomizing sprayer and said form sprayer each comprises a main body and a container for containing the necessary treatment solution, respectively, said containers being so constructed as to be removable from said main body.

* * * * *